US008112908B2

(12) United States Patent
Visser

(10) Patent No.: US 8,112,908 B2
(45) Date of Patent: Feb. 14, 2012

(54) SHOE WITH REMOVABLE/INTERCHANGEABLE HEEL AND RELATED METHOD

(76) Inventor: Jayne Visser, Missoula, MT (US)

( * ) Notice: Subject to any disclaimer, the term of this patent is extended or adjusted under 35 U.S.C. 154(b) by 868 days.

(21) Appl. No.: 12/078,253

(22) Filed: Mar. 28, 2008

(65) Prior Publication Data

US 2008/0235991 A1 Oct. 2, 2008

Related U.S. Application Data

(60) Provisional application No. 60/907,319, filed on Mar. 28, 2007.

(51) Int. Cl.
*A43B 3/24* (2006.01)
*A43B 21/46* (2006.01)

(52) U.S. Cl. ..... 36/100; 36/42; 36/15

(58) Field of Classification Search ..... 36/100, 36/15, 42, 36 R, 24.5
See application file for complete search history.

(56) References Cited

U.S. PATENT DOCUMENTS

| | | | | | |
|---|---|---|---|---|---|
| 2,600,511 | A | | 6/1952 | Lövy | |
| 2,707,341 | A | * | 5/1955 | Romano | 36/34 R |
| 2,767,489 | A | * | 10/1956 | Sturman | 36/34 R |
| 2,829,447 | A | * | 4/1958 | Odom | 36/42 |
| 3,040,453 | A | | 6/1962 | Gallardo | |
| 4,219,946 | A | | 9/1980 | Baum | |
| 4,610,100 | A | * | 9/1986 | Rhodes | 36/42 |
| 5,058,290 | A | * | 10/1991 | Koehl et al. | 36/42 |
| 5,309,651 | A | * | 5/1994 | Handel | 36/100 |
| 5,347,730 | A | | 9/1994 | Rodriguez Colon | |
| 5,456,026 | A | | 10/1995 | Lewis | |
| 5,581,910 | A | | 12/1996 | Lewis | |
| 5,675,916 | A | | 10/1997 | Lewis | |
| 5,953,836 | A | * | 9/1999 | Watt et al. | 36/42 |
| 6,023,858 | A | * | 2/2000 | Srourian | 36/42 |
| 6,631,570 | B1 | | 10/2003 | Walker | |
| 7,185,448 | B2 | | 3/2007 | Schupbach | |
| 2002/0144436 | A1 | * | 10/2002 | Magallanes et al. | 36/100 |

OTHER PUBLICATIONS

"Nike new Sneakers," News from gadgets' world, http://blog.pcnews.ro/2007/06/26/nike-new-sneakers, Mar. 28, 2008, pp. 1-14.
Clothier, J., "Taking the pain out of high heels," CNN.International.com: Technology Spark, http://edition.cnn.com/2004/TECH/09/02/ella.kilgour, Mar. 28, 2008, pp. 1-2.
"Sensible shoes for work that become killer heels at night," the Daily Mail, http://dailymail.co.uk/pages/live/femail/article.html?in_article_id=456911&in_page..., Mar. 28, 2008, pp. 4-15.
ACA Staff, "High tech heels: It's time for a new beginning . . . " http://aca.ninemsn.com.au/article.aspx?id=271603, Mar. 28, 2008, pp. 1-2.

(Continued)

*Primary Examiner* — Jila Mohandesi
(74) *Attorney, Agent, or Firm* — Nixon & Vanderhye, P.C.

(57) ABSTRACT

A shoe with a removable and interchangeable heel includes a first fixed heel disposed on a heel bottom portion of the shoe. The fixed heel includes a first fastener disposed therein. A second removable and interchangeable heel has a cooperating second fastener disposed therein that is engageable with the first fastener to secure the removable heel to the fixed heel, thereby increasing the effective height of the heel of the shoe.

13 Claims, 4 Drawing Sheets

OTHER PUBLICATIONS

"Collapsible High Heels," ShoppingBlog.com, http://www.shoppingblog.com/cgi-bin/sblog.pl?sblog=622071, Mar. 28, 2008, pp. 1-3.

"More than just 'shoes'," Popgadget Personal Technology for Women: Jan. 2005 Archives, http://www.popgadget.net/2005/01/index.php?page=5, Mar. 28, 2008, p. 7.

* cited by examiner

SHOE WITH REMOVABLE/INTERCHANGEABLE HEEL AND RELATED METHOD

Priority is claimed from U.S. Provisional Application Ser. No. 60/907,319, filed Mar. 28, 2007.

The present invention relates to a shoe, sandal or the like with a removable and interchangeable heel and a method of altering the effective height of the heel of the shoe.

BACKGROUND OF THE INVENTION

High heel shoes and pumps are, of course, well known. However, high heel shoes can be uncomfortable and, after extended use, have a tendency to make a user's feet ache. Thus, many people have to either carry a more comfortable pair of shoes on days that they wear high heels, or simply avoid wearing high heels all together, because they cannot tolerate extended wear times.

Additionally, high heels are not practical in terms of the range of activities for which they can be worn. For example, walking extended distances or standing for extended periods of time in high heels can be difficult.

Thus, it is desirable to provide a high heel shoe that can be worn comfortably by a user for a broad range of activities without compromising the aesthetic value of the high heel style.

BRIEF DESCRIPTION OF THE INVENTION

According to a first exemplary and nonlimiting aspect of the invention, a shoe is provided that also has an additional removable and interchangeable heel. The shoe includes a first fixed heel disposed on a heel bottom portion of the shoe. The fixed heel includes a first fastener, such as a nut, embedded (or otherwise secured) in a blind bore or recess extending from a bottom surface of the fixed heel. A second removable and interchangeable heel is also provided for selective attachment to the shoe whenever it is regarded as desirable to increase the effective height of the heel. This second heel incorporates a second fastener, such as a bolt, so that a portion of the bolt extends above the upper end of the second removable heel. The bolt is engageable with the nut disposed in the fixed heel to thereby secure the second removable heel to the first fixed heel, thus changing, i.e., increasing, the effective height of the heel of the shoe.

Another feature of the invention is to form the second removable heel with an upstanding collar that substantially encloses three sides of the fixed heel when the second heel is attached.

It is another feature of the invention that plural, removable and interchangeable heels of varying height are provided, for selective attachment to the fixed heel.

According to a second exemplary and nonlimiting aspect of the invention, a method of changing the effective height of the heel of a shoe is provided. The method includes providing a first fixed heel disposed on a heel bottom portion the shoe. A nut or other fastener is disposed in a bottom surface of the fixed heel. A second removable and interchangeable heel is also provided, incorporating a second complimentary fastener, such as a threaded bolt, a portion of the bolt extending above the upper surface of the removable heel. The method in one embodiment may further include screwing the bolt in the second removable heel into the nut in the first fixed heel so that the second removable heel is secured to the first fixed heel, thereby increasing the effective height of the heel of the shoe.

DETAILED DESCRIPTION OF THE INVENTION

Figure 1:
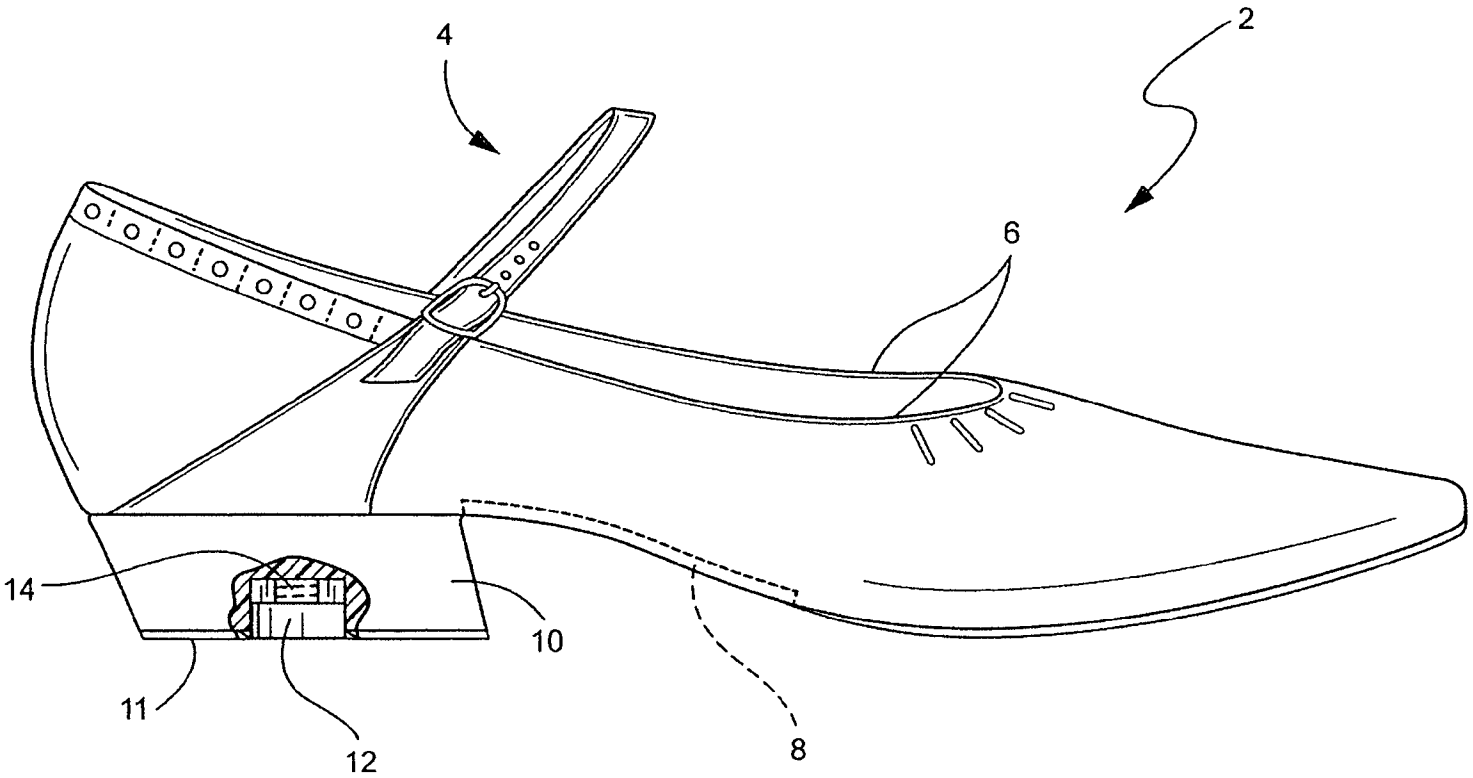
FIG. 1 is a perspective view, partially in section, of a shoe in a first configuration according to an exemplary and nonlimiting embodiment of the present invention.

Reference will now be made in detail to the exemplary and nonlimiting embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

As best shown in FIG. 1, a shoe 2 includes a first fixed heel 10 that provides a first, as purchased height to the heel of the shoe 2. The fixed heel 10 has a height within a range that is not normally considered a "high heel". In one exemplary embodiment, the fixed heel 10 includes a threaded nut 14 embedded or otherwise fixedly secured in the heel 10 for facilitating attachment of a second removable and interchangeable heel, as described in detail further below.

Figure 2B:
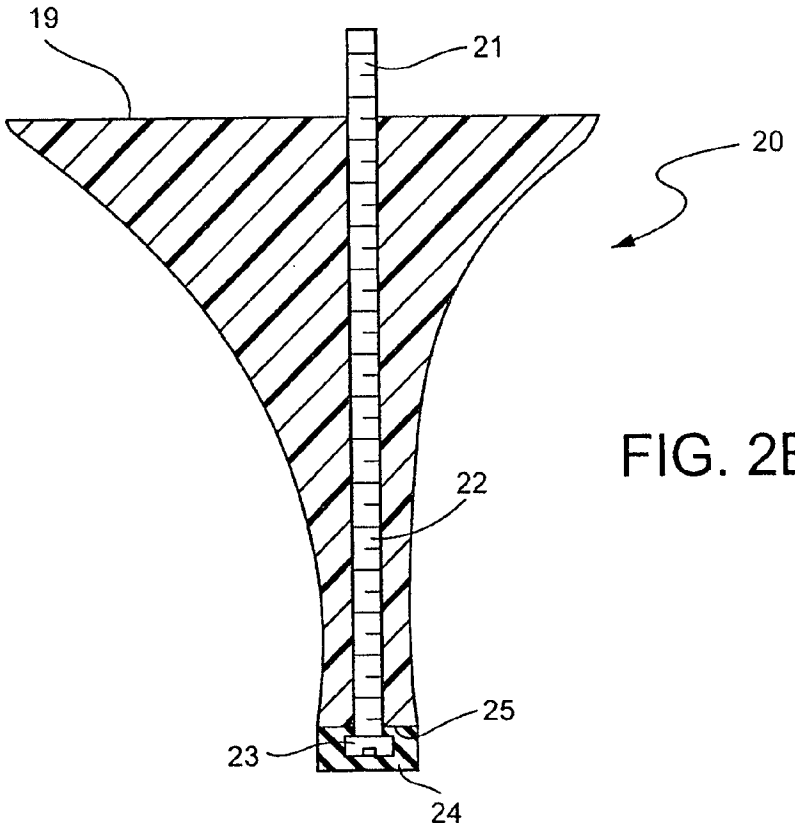
FIG. 2B is a side elevational view, partially in section, of a second removable heel that can be attached to the shoe of FIG. 1.
Figure 2A:
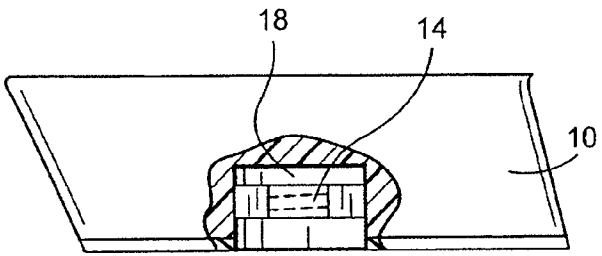
FIG. 2A is a partial section view of a first fixed heel where a fastener in the heel is relocated as compared to FIG. 1.

As best shown in FIG. 2A, the nut 14 is disposed in a blind bore or recess 18 extending into the heel 10 from a bottom surface thereof, thus permitting access to the nut. Returning to FIG. 1, a resilient plug 12 is removably disposed in the bore or recess 18 formed in the fixed heel 10 to prevent dirt and debris from accumulating not only in the bore or recess 18, but also in the threaded area of the nut 14. The plug 12 may be made of, for example, rubber, plastic or other suitable material, and has a flat portion that is preferably substantially flush with the flat bottom surface 11 of the fixed heel 10 so as not be felt by a user when wearing the shoe 2.

Figure 2C:
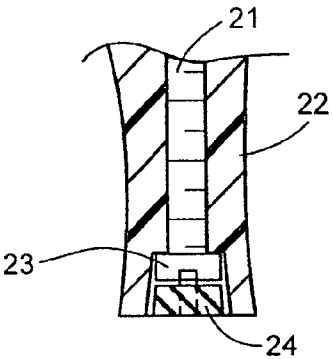
FIG. 2C is a partial section of a removable heel as shown in FIG. 2B, but with an alternative heel tip arrangement.

As best shown in FIG. 2B, the shoe 2 may be modified to the extent of changing its effective heel height by attachment of a second removable and interchangeable heel 20 having a threaded bolt 22 disposed lengthwise therein so that a head 23 of the bolt 22 is accessible from a flat bottom surface 25 of the removable heel 20. Bolt 22 extends through a bore in the second removable heel, with an end portion 21 (note that only the exposed end portion 21 of the bolt shank need be threaded) extending beyond the upper surface 19 of the heel. The removable heel 20 can be secured to the fixed heel 10 of the shoe 2 by removing the plug 12, and then threading the bolt 22 into the nut 14 using, for example, a screw driver or the like, applied to the head 23 of the bolt, until the second removable heel is tightly secured to the first fixed heel 10. The upper surface 19 of the second removable heel 20, and the lower surface 11 of the fixed heel 10 are complementary in shape so that the shoe 2 has an aesthetically attractive appearance. The bolt head 23 may be countersunk within the lower end of the heel 22, with a plug 24 similar to plug 12 covering the head 23 as shown in FIG. 2C, or with a conventional heel tip 24' applied over the exposed head 23 and bottom surface of the heel as shown in FIG. 2B. These arrangements prevent the head 23 from impacting a surface being walked on by a user wearing the shoe 2. More specifically, the impact absorbing plug 24 or tip 24' prevents the head 23 of the bolt 22 from scratching hardwood floors, etc. while also preventing unnecessary stress on the removable heel 20. The impact absorbing plug 24 or tip 24' may be made from rubber, plastic or the like and may be removably secured to the surface 25 by any suitable means.

While bolt 22 is shown extending the full length of the removable heel 20, it may be appreciated that the bolt 22 need only extend into the removable heel 20 a distance sufficient to provide a rigid connection to the fixed heel 10. Thus the bolt could be molded into, or otherwise embedded within the second removable heel, with the threaded shank portion 21 extending the necessary distance above surface 19 to allow shank 21 to be threaded into nut 14 via rotation of the removable heel 20 relative to the fixed heel 10. Also, while the nut 14 is illustrated at the distal end of bore 18, it may be located at the proximal end of the bore or in the mid-portion of the bore as shown in FIG. 2A so that the length of shank 21 need not be precisely controlled. In other words, so long as the bore 18 is of sufficient depth, the shank 21 may extend through nut 18 while still providing a rigid connection.

Figure 3:
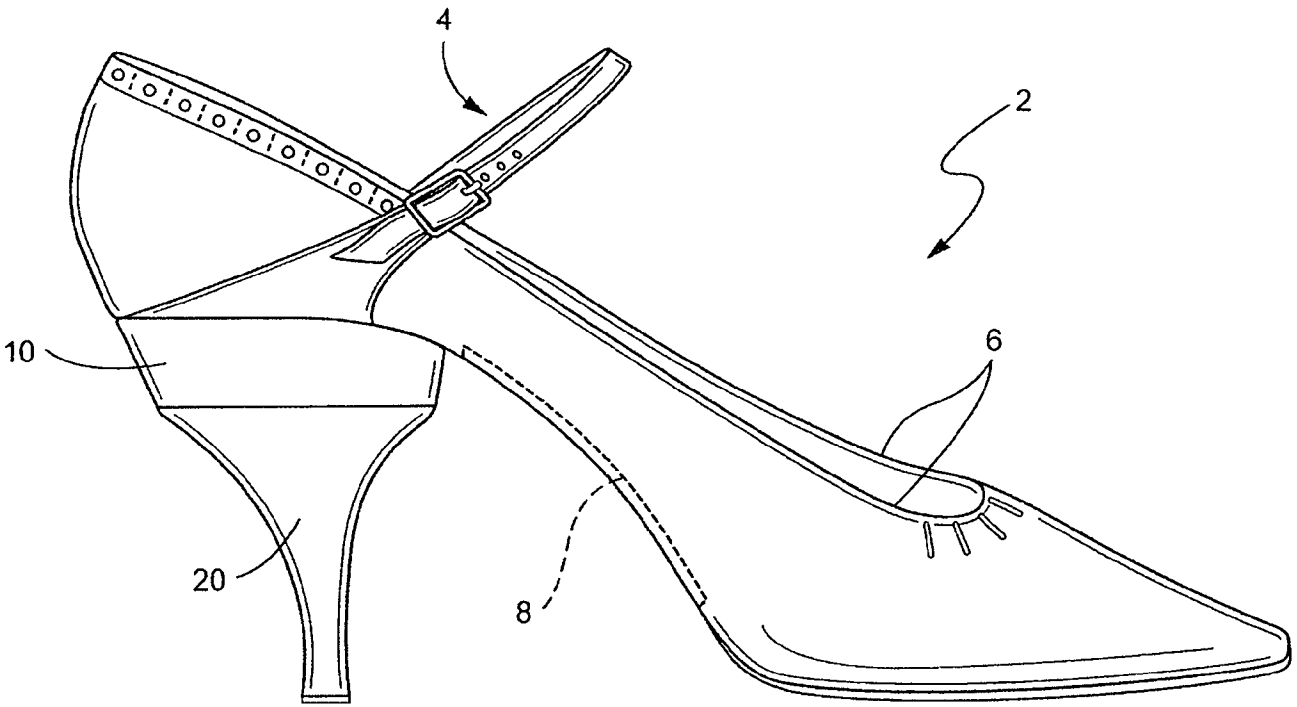
FIG. 3 is a perspective view of the shoe of FIG. 1 having the removable and interchangeable heel of FIG. 2B attached thereto.

The removable heel 20, having a height in a range, for example, of about 1 to about 5 inches, thus provides a second alternative height to the shoe 2, in addition to the first height provided by the fixed heel 10, as best shown in FIG. 3. It will be appreciated that additional interchangeable heels of varying height could be attached to the fixed heel 10 of the shoe 2. For example, plural interchangeable heels may be provided with heights varying in a range of from about one to about 5 inches, and preferably about 2 to 5 inches, thereby permitting the user to selectively change the effective height of the shoe heel as desired.

It will be appreciated that the shoe 2 deforms when it is transformed from the flat configuration of FIG. 1 to the high heel configuration of FIG. 3. Accordingly, and as best seen in FIGS. 1 and 3, the shoe 2 further includes an elastic band portion 6 disposed around a perimeter of the opening of the shoe 2 near the front or toe end of the shoe. The elastic band portion 6 allows the shoe 2 to take different shapes when the removable heel 20 is applied to the fixed heel 10 and when the removable heel 20 is not applied to the fixed heel 10. As a result, the shoe 2 can be worn comfortably with or without the removable heel 20. The shoe 2 may include a curved metal plate 8 disposed within the arch portion of the sole of the shoe 2 to provide additional arch support. The curved metal plate 8 is substantially rigid and provides the shape associated with a high heel, yet does not provide discomfort when the shoe 2 is worn without the removable heel 20. The plate 8 preferably is covered by the leather, plastic or other material that forms the sole of shoe 2, i.e., the plate 8 is located within the sole, and not externally visible.

As best shown in FIGS. 1 and 3, the shoe 2 further may include a strap 4 that is adjustable for the user's comfort. The strap 4 may be adjusted to different settings for providing different amounts of support based on whether the removable heel 20 is attached to the shoe 2. It will be appreciated that the invention is not limited to any specific style of shoe but rather, is applicable to virtually all styles of shoes, sandals or the like.

A method of using the shoe 2 of the present invention will now be described with reference to FIGS. 1 through 3. First, the shoe 2 can be worn without the removable heel 20 for more comfort, for example, in a less formal setting. Here, the plug 12 is employed and prevents dirt from entering the bore or slot 18 in which the nut 14 is disposed. Additionally, the elastic portion 6 allows the shape of the shoe 2 to adapt to the height of the fixed heel 10 to make a user's foot comfortable.

Next, a user can change the effective height of the heel of the shoe by adding the second removable heel 20. This is done by removing the plug 12 and screwing the bolt 22 into the corresponding nut 14 in the fixed heel 10 (or by rotating the heel 20 relative to heel 10 if the bolt 22 does not extend completely through the heel 22). When worn in this state, the curved metal plate 8 provides the necessary support and shape to the shoe 2 for the cumulative height of the fixed heel 10 and the removable heel 20. The elastic portion 6 also allows the shape of the front end of the shoe 2 to adapt to the combined height of the fixed heel 10 and the removable heel 20 to make a user's foot comfortable.

Figure 4:
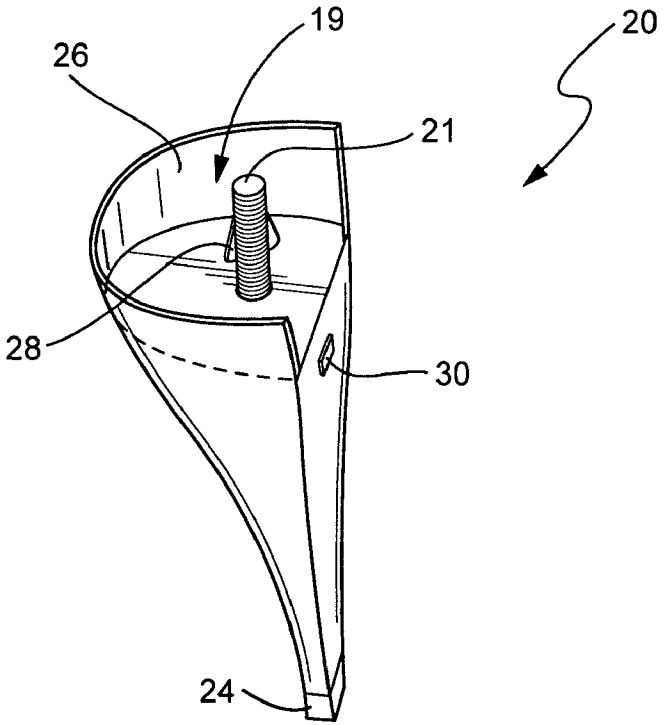
FIG. 4 is a perspective view of an alternative embodiment of a removable and interchangeable heel in accordance with the invention.

With reference to FIG. 4, the removable and interchangeable heel 20 may be formed with an integral, upstanding, substantially rigid collar 26. The collar surrounds the fixed heel on three sides, with the front side left open. The height of the collar is substantially the same as the height of the first fixed heel 10, and substantially covers the peripheral surface of heel 10, with the exception of the normally unseen front edge or side thereof. The collar 26 thus provides a more integrated and streamlined appearance by hiding the seam between the two heels 10 and 20, and the otherwise unattractive worn edges at the bottom edge of the first fixed heel. With the collared second heel 20 in place, it is not apparent that a second heel has been added to the first heel.

The threaded shank 21 may be provided with, for example, a pair of spring-loaded, hinged wings 28 that will collapse as the interchangeable heel 20 is inverted into the fixed heel 10 and then spring outwardly within a recess provided in the fixed heel to thereby secure the heel 20 in place. A release button 30 may be utilized to pull the wings into the shank 21, via any suitable linkage arrangement, thus permitting removal of the heel 20. This arrangement is merely exemplary of any number of known lock and release configurations that may be used to attach and release the heel 20.

The shoe 2 as described thus provides the convenience to a user of being able to adapt a single pair of shoes between one or more high heel settings and a low heel setting. Accordingly, a user can easily remove the removable heel 20 to wear the shoe 2 more comfortably with a low heel style, and can also easily attach the removable heel 20 (or one of several interchangeable heels of varying height) for a more formal look with a high heel style. Therefore, a user need not carry an additional pair of shoes in order to wear both styles. Additionally, the shoe 2 can be worn during a broader range of activities than the conventional high heel shoe. While I illustrate the shoe 2 as being a low or flat shoe in FIG. 1, it may be appreciated that the attachable, interchangeable heel 20 may be used with other types and styles of footwear.

Although a few embodiments of the present invention have been shown and described, it will be appreciated by those skilled in the art that changes may be made in these embodiments without departing from the principles and spirit of the invention, the scope of which is defined in the appended claims and their equivalents. For example, while the complimentary fasteners for attaching the first and second heels have been disclosed as a combination nut and bolt, it will be appreciated that other securement techniques may be employed.

For example, bayonet-type, snap-fit, or other preferably "quick-connect" arrangements are within the scope of the invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A shoe, comprising:

a first fixed heel disposed on a heel bottom portion of said shoe, said fixed heel including a first fastener disposed in a recess provided therein, said recess covered by a removable plug when said second heel is not attached; and a second removable heel having a second fastener disposed therein, said second fastener adapted for operable engagement with said first fastener, one portion of said second fastener extending from said second removable heel so that said second fastener may engage said first fastener to secure said second removable heel to said first fixed heel, said second fastener further comprising a fastener-actuating portion accessible from an opposite end of said second removable heel, and covered by a removable plug or tip; and wherein said second heel is formed with an integral collar adapted to substantially enclose said first fixed heel.

2. The shoe according to claim 1 wherein said second heel has a height of between about 1 inch and about 5 inches.

3. The shoe according to claim 1 wherein said second heel has a height greater than said first fixed heel.

4. The shoe according to claim 1 wherein said first fastener comprises a nut and said second fastener comprises a shank, at least a portion of which is threaded and adapted to threadably engage said nut.

5. The shoe according to claim 1 wherein said fastener-actuating portion is countersunk within a bottom end portion of said second removable heel.

6. The shoe according to claim 1 and further comprising a curved sole plate located within an arch portion of a sole of the shoe.

7. A method of increasing the effective height of a heel of a shoe, the method comprising the steps of:

a. providing a first fixed heel disposed on a heel bottom portion of the shoe, said first fixed heel including a first fastener disposed in a recess formed in a bottom of said first fixed heel;

b. providing a second removable heel formed with an integral collar adapted to substantially enclose said first fixed heel, said second removable heel having a cooperating second fastener, a first portion of the second fastener extending from one end of said second removable heel; and a second actuator portion of said second fastener accessible from an opposite end of said second removable heel; and c. employing said second actuator portion, securing said first portion of said second fastener to the first fastener so that the second removable heel is secured to the first fixed heel, thereby increasing the effective heel height of the shoe.

8. A method according claim 7 wherein step b is carried out by providing plural, selectively interchangeable second heels of varying heights.

9. A method according claim 7 wherein said second removable heel has a height of between about 1 inch and about 5 inches.

10. A method according claim 7 wherein said second removable heel has a height greater than said first fixed heel.

11. A method according claim 7 wherein said first fastener comprises a nut and said first portion of said second fastener is threaded; and wherein step c is carried out by threadably engaging said first portion of said second fastener with said nut.

12. A method according claim 7 further comprising covering said recess with a first removable plug when said second removable heel is not attached.

13. A method according claim 7 including providing a curved metal plate within an arch portion of a sole of the shoe.

* * * * *